US006529177B2

(12) United States Patent
Nakamura

(10) Patent No.: US 6,529,177 B2
(45) Date of Patent: Mar. 4, 2003

(54) PLASMA DISPLAY WITH REDUCED POWER CONSUMPTION

(75) Inventor: Tadashi Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 13 days.

(21) Appl. No.: 09/808,300

(22) Filed: Mar. 14, 2001

(65) Prior Publication Data

US 2001/0024179 A1 Sep. 27, 2001

(30) Foreign Application Priority Data

Mar. 23, 2000 (JP) ..... 2000-082872

(51) Int. Cl.[7] ..... G09G 3/28

(52) U.S. Cl. ..... 345/60; 345/66; 345/67; 345/68; 345/204; 345/211; 313/581; 313/582; 313/584; 315/169.1; 315/169.2; 315/169.4

(58) Field of Search ..... 345/35–37, 41–43, 345/55, 58, 204, 205, 211–214, 691–694, 60–63, 66–68; 315/169.1, 169.2, 169.4; 313/581, 582, 584, 590

(56) References Cited

U.S. PATENT DOCUMENTS 5,790,087 A * 8/1998 Shigeta et al. ..... 345/62
5,854,540 A * 12/1998 Matsumoto et al. ..... 315/169.1
5,990,630 A * 11/1999 Nakamura ..... 315/169.1
6,054,970 A * 4/2000 Hirakawa et al. ..... 345/60
6,195,075 B1 * 2/2001 Shino et al. ..... 345/60
6,356,249 B1 * 3/2002 Lim ..... 345/63
6,392,616 B1 * 5/2002 Suzuki et al. ..... 345/208

FOREIGN PATENT DOCUMENTS

JP 08-305319 11/1996
JP 10-198304 7/1998

* cited by examiner

*Primary Examiner*—Richard Hjerpe
*Assistant Examiner*—Henry N. Tran
(74) *Attorney, Agent, or Firm*—Whitham, Curtis, and Christofferson, P.C.

(57) ABSTRACT

A plasma display device that operates stably at low power consumption comprises a plurality of scan electrodes, a plurality of data electrode groups, a data pulse phase control circuit, and data drivers. The data pulse phase control circuit generates, at a different phase for each data electrode group, pulse strings that are composed of consecutive pulses in which the start timing of the first pulse is delayed and the end timing of the last pulse is advanced. A data driver is provided for each data electrode group, and these data drivers apply to the data electrodes display data that are synchronized with the pulse strings. The data electrodes in the plurality of data electrode groups realize screen display by the discharge that occurs at the intersections with the scan electrodes upon the application of data pulses.

12 Claims, 12 Drawing Sheets

PLASMA DISPLAY WITH REDUCED POWER CONSUMPTION

BACKGROUND OF THE INVENTION

1. Field of the Invention

The present invention relates to a method of driving an AC discharge memory-operating type plasma display panel and to a plasma display device in which a plurality of scan electrodes and a plurality of data electrodes are arranged to intersect with each other, discharge is generated at the intersections of the scan electrodes and the data electrodes upon application of a desired data pulse to the data electrodes to effect and screen display.

2. Description of the Related Art

PDP (plasma display panels) generally offer many features, including thin construction, a low level of flicker, a high display contrast ratio, relative ease of application to large screens, and a high response speed. In addition, PDP are self-light emitting and are therefore capable of multicolor emission through the use of phosphors. Due to these features, the use of PDP has been expanding in recent years in the fields of large public display devices and color television.

PDP include the ac-discharge type, in which electrodes are covered by a dielectric, that operates in a state of indirect AC discharge; and the dc discharge type, in which electrodes are exposed in a discharge space, that operates in a direct-current discharge state.

The ac discharge type includes a memory-operating type that uses the memory of a discharge cell; and a refresh-operation type that does not use the memory of a discharge cell. The luminance of both the memory-operating type of PDP and the refresh operation type of PDP is substantially proportional to the number of discharges, i.e., the number of repeated voltage pulses. The refresh operation type of PDP exhibits a decrease in luminance if the display capacitance is increased, and this type of PDP is therefore used in PDP having little display capacitance.

FIG. 1 is a perspective sectional view showing the construction of a display cell in an ac-discharge memory-operating type of PDP. The PDP comprised by: insulating substrates 1 and 2, scan electrodes 3, sustain electrodes 4, bus electrodes 5 and 6, data electrodes 7, discharge gas space 8, phosphor 11, dielectric layer 12, protective layer 13, dielectric layer 14, and barriers 9.

The front surface and back surface, i.e., insulating substrates 1 and 2, are made of glass. Transparent scan electrodes 3 and transparent sustain electrodes 4 are formed on insulating substrate 2. Bus electrodes 5 and 6 are arranged to overlie scan electrodes 3 and sustain electrodes 4 to reduce the electrode resistance. Data electrodes 7 are formed on insulating substrate 1 orthogonal to scan electrodes 3 and sustain electrodes 4. Discharge gas space 8 is the space between insulating substrate 1 and insulating substrate 2 and is filled with a discharge gas that is composed of helium, neon, or xenon, or a compound gas of these gases. Phosphor 11 converts the ultraviolet light that is generated by discharge of the discharge gas to visible light 10. Dielectric layer 12 covers scan electrodes 3 and sustain electrodes 4. Protective layer 13 is a layer made of magnesium oxide or the like and protects dielectric layer 12 from discharge. Dielectric layer 14 covers data electrodes 7. Barriers 9 partition display cells from other adjacent display cells. The surface of data electrodes 7 is covered by dielectric layer 14.

A plurality of barriers 9 are provided on the surface of dielectric layer 14. Phosphor 11 is applied to the surface of dielectric layer 14 between adjacent barriers 9 and to the side surfaces of barriers 9.

FIG. 2 is a vertical section of a single display cell in the AC discharge memory-operating type of PDP shown in FIG. 1.

The discharge operation of the selected display cell is next described with reference to FIG. 2. Discharge occurs when a pulse voltage that exceeds a discharge threshold value is applied between scan electrode 3 and data electrode 7. When discharge occurs, the positive and negative charges that are generated by the discharge are absorbed into the surfaces on both sides, i.e., into the surface of dielectric layer 12 and phosphor 11, and charge accumulation takes place according to the polarity of the applied pulse voltage. This charge is hereinbelow referred to as "barrier charge." The equivalent internal voltage that is generated by the accumulation of this charge at the two ends of discharge gas space 8 (in FIG. 2, above and below the plane of the figure), i.e., barrier voltage, is of the opposite polarity of the pulse voltage. The effective voltage inside the display cell therefore drops with increase in the barrier charge even though the applied pulse voltage is kept at a fixed value. When the effective voltage inside the display cell falls to the extent that discharge can no longer be sustained, discharge ceases. If the polarity of the voltage that is applied to data electrode 7 is reversed at this time, the barrier charge is erased. Since the collision of positive charge of high mass with phosphor 11 shortens the life of the phosphor, a voltage that is positive with respect to scan electrode 4 is applied to data electrode 7 such that negative charge (electrons) of low mass are stored in the surface of phosphor 11. In order to sustain discharge in this state, sustain electrodes 4 are provided parallel to scan electrodes 3, and a sustaining discharge is continued between scan electrodes 3 and sustain electrodes 4. Thus, after discharge between data electrode 7 and scan electrode 4 is initiated in a selected display cell that is to emit light, a sustaining discharge pulse, which is a pulse voltage of the same polarity as the barrier voltage, is applied between adjacent scan electrode 3 and sustain electrode 4, whereby the effective voltage is equivalent to the barrier voltage added to the voltage of the sustaining discharge pulse. The effective voltage therefore exceeds the discharge threshold value even though the voltage of the sustaining discharge pulse is low, and discharge is thus sustained. Discharge is thus sustained through the application of sustaining discharge pulses alternately to scan electrode 3 and sustain electrode 4. This function is the above-described memory function.

The sustain discharge is halted by applying, as an erase pulse, a wide pulse of low voltage or a narrow pulse of approximately the same voltage level as the sustaining discharge pulse to scan electrode 3 or sustain electrode 4 so as to neutralize the barrier voltage.

FIG. 3 is a block diagram showing: a PDP that is formed by arranging display cells such as shown in FIG. 2 in a matrix, a control circuit, a scan driver, a sustain driver, and a data driver.

PDP 15 is a panel for dot matrix display in which mxn display cells 16 are arranged. In PDP 15, scan electrodes X1, X2, . . . , Xm and sustain electrodes Y1, Y2, . . . , Ym arranged parallel to each other are provided as row electrodes; and data electrodes D1, D2, . . . , Dn arranged orthogonal to the row electrodes are provided as column electrodes.

Scan driver 21 applies a voltage of the scan electrode drive waveform to scan electrodes X1, X2, . . . , Xm. Sustain driver 22 applies a voltage of the sustain electrode drive waveform to sustain electrodes Y1, Y2, . . . , Ym. Data driver 50 applies a voltage of the data electrode drive waveform to data electrodes D1, D2, . . . , Dn.

Control circuit 60 generates signals for controlling data driver 50, scan driver 21, and sustain driver 22 based on vertical synchronizing signals Vsync, horizontal synchronizing signals Hsync, clock signals "Clock," and display data signals DATA.

Display data signal DATA are signals indicative of the data that are to be displayed in each display cell. Vertical synchronizing signal Vsync is a signal indicative of the period of a frame in which a series of operations is concluded, from a preparatory discharge interval until an erase discharge interval, and the starting point of the frame. In addition, if one frame is made up of a plurality of fields, and each field contains from the preparatory discharge interval up to the sustain discharge interval, the fields may be constituted asynchronous with vertical synchronizing signal Vsync. Vertical synchronizing signal Vsync may also indicate the period and the start point of one field. Although horizontal synchronizing signal Hsync is a signal that designates the start of scanning for each horizontal scanning line in a CRT, in a PDP, it is used as a signal that indicates the timing for taking in display data signal DATA for each horizontal scanning line. Clock signal "Clock" is a reference clock for transferring display data signals DATA.

The drive method of a PDP with a construction of the foregoing description will described below.

FIG. 4 shows a timing chart of the output waveforms of scan driver 21, sustain driver 22, and data driver 20 of the PDP shown in FIG. 3.

Sustain electrode drive pulse signal Wu is a voltage signal that is applied in common to sustain electrodes Y1, Y2, . . . , Ym. Scan electrode drive pulse signals Ws1, Ws2, . . . , Wsm are voltage signals that are applied to scan electrodes X1, X2, . . . , Xm, respectively. Data electrode drive pulse signal Wd is a voltage signal that is applied to data electrode Di for $1 \leqq i \leqq n$). Driving the PDP involves performing a preparatory discharge interval, a write discharge interval, a sustaining discharge interval, and an erase discharge interval as one period.

The preparatory discharge interval is a time interval for generating barrier charge and activated particles inside the discharge gas space in order to obtain a stable write discharge characteristic in the write discharge interval. A preparatory discharge pulse Pp is first applied to simultaneously discharge all display cells of PDP 15. Preparatory discharge erase pulse Ppe is then applied to all scan electrodes in order to eliminate the charge of the created barrier charge that would interfere with write discharge and sustaining discharge. In other words, preparatory discharge pulse Pp is first applied to scan electrodes X1, X2, . . . , Xm to bring about preparatory discharge in all display cells. Next, the potential of sustain electrodes Y1, Y2, . . . , Ym is raised to the level of sustain voltage Vs, and in addition, preparatory discharge erase pulse Ppe having a potential that gradually drops is applied to scan electrodes X1, X2, . . . , Xm to bring about erase discharge. When erase discharge occurs, the barrier voltage that has accumulated due to preparatory discharge pulse is relaxed. Erasing that is described here refers to either eliminating all barrier charge or adjusting the amount of barrier charge to facilitate subsequent write discharge or sustaining discharge.

The write discharge interval is a time interval for causing selected display cells that are to emit light to discharge, and for creating barrier charge. Scan pulse Pw is successively applied to each of scan electrodes X1, X2, . . . , Xm, and in synchronism with this scan pulse Pw, data pulse Pd is selectively applied to data electrode Di for $1 \leqq i \leqq n$ of display cells in which display is to be effected. Write discharge is thus generated and barrier charge created.

The sustaining discharge interval is a time interval for sustaining the discharge of display cells in which barrier charge was generated during the write discharge interval. In order to effect a desired luminance in display cells in which write discharge was effected in a write discharge interval, sustaining discharge pulse Pc is applied to scan electrodes X1, X2, . . . , Xm and sustaining discharge pulse Ps having a phase that is delayed 180 degrees from that of the sustaining discharge pulse Pc is applied to sustain electrodes Y1, Y2, . . . , Ym repeatedly and alternately for a required number of times. The necessary number of sustaining discharges is thus repeated. In this case, the amplitude of scan electrodes X1, X2, . . . , Xm and sustain electrodes Y1, Y2, . . . , Ym is assumed to be Vs. The potential difference between scan electrodes X1, X2, . . . , Xm and sustain electrodes Y1, Y2, . . . , Ym is set such that the voltage obtained by adding the voltage resulting from barrier charge to Vs is a value that exceeds the voltage for initiating discharge.

The erase discharge interval is a time interval for adjusting the amount of barrier charge so as to facilitate subsequent preparatory discharge, write discharge, and sustaining discharge. Erase discharge occurs when erase pulse Pe having a gradually falling potential is applied to scan electrodes X1, X2, , Xm, to erase the barrier charge that has accumulated due to sustaining discharge. Erasing in this case refers to entirely eliminating barrier charge or adjusting the amount of barrier charge so as to facilitate subsequent preparatory discharge, write discharge, or sustaining discharge.

Data pulses Pd are not applied to display cells in which light emission is not desired (GND potential in FIG. 4), and the occurrence of discharge is thus prevented.

A desired image is thus displayed on the PDP by means of the series of operations from preparatory discharge interval to erase discharge interval. In the above-described write discharge interval, data pulse Pd is applied to all data electrodes at the same timing, whereby a light emission current flows in unison for each scan electrode immediately after the application of both scan pulse Pw and data pulse Pd. As a result, there is the problem that, in a case in which the light emission current is large, such as in a PDP having a large display screen, a sufficient voltage characteristic for bringing about write discharge in display cells cannot be obtained due to the voltage drop caused by driver output impedance or the electrode wiring resistance of the PDP. "Electrode wiring" refers to scan electrodes 3, sustain electrodes 4, bus electrodes 5, 6, or data electrodes 7. In addition, "electrode wiring resistance of scan electrodes 3 and sustain electrodes 4" refers to the resistance between scan electrodes 3 and sustain electrodes 4 on one hand and bus electrodes 5 and 6 on the other.

Not only does a light emission current flow to the electrodes, but a current also flows for charging and discharging the electrostatic capacity between electrodes, and the capacity becomes a load with respect to the application of a drive pulse. Narrowing the picture element pitch or increasing screen size in the interest of raising the degree of detail of the PDP shrinks the distance between electrodes and increases the length of electrode wiring, whereby the electrostatic capacity between electrodes increases, and this current attains a high value. When the current for charging and discharging becomes large, the noise level generated by this current also increases. This noise influences other signals and causes erroneous writing in display cells. This noise is also undesirable in that it is also a source of noise that is radiated to the outside. Furthermore, raising the drive voltage to each driver to compensate for the amount of voltage drop causes light emission of display cells in which light emission is not desired.

The present applicant has already disclosed a method for solving these problems in the publication of Japanese Patent No. 2950270. In this method, the data electrodes are divided into a plurality of data electrode groups (an example is here shown in which the data electrodes are divided into two groups: data electrodes Da1–Daj and data electrodes Db1–Dbk) as shown in FIG. 5, and the phase of the data pulses of a write discharge interval is shifted for each data electrode group.

The signals that are applied to each electrode have the waveforms as shown in FIG. 6. Sustain electrode drive pulse signal Wu is the signal that is applied in common to sustain electrodes Y1, Y2, . . . , Ym. Scan electrode drive pulse signals Ws1, Ws2, . . . , Wsm are the signals that are applied to scan electrodes X1, X2, . . . , Xm, respectively. Data electrode drive pulse signal Wa is the signal that is applied to data electrodes Da1, Da2, . . . , Daj. Data electrode drive pulse signal Wb is the signal that is applied to data electrodes Db1, Db2, . . . , Dbk. One period (one frame) includes a first field and a second field, and the first and second fields are each composed of a preparatory discharge interval, a write discharge interval, and a sustaining discharge interval.

In the write discharge interval of the first field, the pulse width of the data pulses that are applied to data electrodes Da1, Da2, . . . , Daj is the same as the scan cycle, while the data pulses applied to data electrodes Db1, Db2, . . . , Dbk have a narrow pulse width with a start timing delayed by time Td from the start time of the data pulse applied to data electrodes Da1, Da2, . . . , Daj. In the write discharge interval of the second field, however, the data pulses that are applied to data electrodes Da1, Da2, . . . , Daj have a narrow pulse width with a start timing delayed by time Td, while the pulse width of the data pulses that are applied to data electrodes Db1, Db2, . . . , Dbk is the same as the scan period.

Since the start timings of the data pulses to data electrodes Da1, Da2, . . . , Daj and the data pulses to data electrodes Db1, Db2, . . . , Dbk diverge from each other, the timing of the light emission current that flows to scan electrodes X1, X2, . . . , Xm is shifted and the peak value of the light emission current is reduced. Data pulses of the width of scan period are always applied to one of the data electrode groups, and regarding the scan of that data electrode group, the pulse output continues without returning to the reference potential if write discharge occurs in consecutive display cells. The charge that accumulates in the electrostatic capacity between electrodes is therefore not charged and discharged, and power consumption can be reduced.

As another means for solving the above-described problem, the present applicant has disclosed the method described in the publication of Japanese Patent No. 2953342. In this method, the data electrodes are divided into a plurality of data electrode groups (An example is here shown in which the data electrodes are divided between first and second data electrode groups). Signals of the waveforms shown in FIG. 7 are applied to each electrode. Sustain electrode drive pulse signal Wu is the signal that is applied in common to the sustain electrodes. Scan electrode drive pulse signals Ws1, Ws2, . . . , Wsm are the signals that are respectively applied to the m scan electrodes. Data electrode drive pulse signal Wa is the signal that is applied to the data electrodes of the first data electrode group, and data electrode drive pulse signal Wb is the signal that is applied to the data electrodes of the second data electrode group.

The pulse start of data electrode drive pulse signal Wa coincides with the switch timing of the scan period, and the pulse ends before the switch timing of the scan period. The pulse start of data electrode drive pulse signal Wb comes after the switch timing of the scan period, and the pulse end coincides with the switch timing of the scan period.

The peak value of the light emission current is reduced by shifting the timing of the light emission current that flows to each of the scan electrodes for the first data electrode group and the second data electrode group.

With the increased attention on environmental issues in recent years, a decrease of power consumption of all electronic devices has been required. The voltage that is applied to electrodes in a PDP is a high voltage of several hundred volts, and since a PDP has a large number of picture elements, even a slight increase or decrease in the current to each of the electrodes results in a large increase or decrease in the current to the entire PDP. In addition, it is known that the increase in the current heat the PDP, thus decreasing the life of the PDP. Decreasing power consumption by whatever means is therefore a crucial issue in the development of PDP.

One method of decreasing power consumption that can be considered in addition to the methods described in the above-described publications involves delaying the start timing and advancing the end timing of the data pulses to one of the data electrode groups. In this method, however, the shortness of the data pulse width of one of the data electrode groups, i.e., the write pulse width, results in cases of insufficient formation of barrier charge. A display cell in which the barrier charge is insufficiently formed does not easily make the transition to sustaining discharge and may not emit light.

SUMMARY OF THE INVENTION

It is an object of the present invention to provide a method of driving an AC discharge memory-operating type plasma display panel, a plasma display device of the kind described at the beginning of this document and that has a low noise level, that suppresses power consumption to a low level, and that has a stable drive voltage.

According to one aspect of the invention, a method of driving a plasma display, comprises the steps of dividing data electrodes into a plurality of data electrode groups, and applying data pulse strings, which are composed of a plurality of consecutive data pulses in which the start timing of the first data pulse is delayed by a predetermined time and the end timing of the last data pulse is advanced by a predetermined time, are applied to data electrodes at a different phase for each data electrode group.

The start timing and the end timing of the data pulses are shifted by the units of the data electrode groups, whereby the combination of the charge/discharge current for charging and discharging the electrostatic capacity between electrodes that accompanies changes in the drive pulse and the light emission current that occurs with discharge can be lowered, thereby decreasing the current peak value, and decreasing noise. Furthermore, because the data pulse string is continuously supplied to the data electrodes, in cases of display data in which the same value is continuously written to display cells, there is no need for return between data pulses to the reference potential, and there is consequently no flow of current for charging and discharging electrode electrostatic capacity and power consumption is reduced.

According to another aspect of the present invention, a plasma display device comprises a plurality of scan electrodes, a plurality of data electrode groups, a data pulse phase control circuit, and data drivers.

The data electrode groups are divisions of a plurality of data electrodes that are arranged to intersect with the scan electrodes and that realize screen display by discharge that is brought about at intersecting points with the scan electrodes upon application of a desired data pulse.

The data pulse phase control circuit creates pulse strings at different phase for each data electrode group, these pulse strings being composed of a plurality of pulses in which the start timing of a first pulse is delayed by a predetermined time and the end timing of the last pulse is advanced by a predetermined timing.

A data driver is provided for each data electrode group, and these data drivers apply to the data electrodes display data that are synchronized with the pulse strings.

According to an embodiment of the present invention, the time by which the start timing of the first data pulse is delayed is determined in advance such that the peak timing of the light emission current diverges from the peak timing of the data electrode current.

According to an embodiment of the present invention, the number of data electrode groups is the same as the number of data pulses that make up the data pulse strings.

According to an embodiment of the present invention, the time by which the start timing of the first data pulse is delayed is the same for all data electrodes, and the time by which the end timing of the last data pulse is advanced is the same for all data electrodes.

According to an embodiment of the present invention, the time of delay and the time of advancement are the same.

According to another embodiment of the present invention, a plurality of scan electrodes and a plurality of data electrodes are arranged to intersect with each other, the data electrodes are divided into K data electrode groups for $2 \leqq K$; and the plasma display panel is driven such that discharge is brought about at the points of intersection between scan electrodes and data electrodes upon the application of a desired data pulse to the data electrodes, and screen display is realized by this discharge.

This plasma display panel drive method successively applies scan signals of a prescribed pulse width to a plurality of scan electrodes, generates mask signals that straddle the points of change of the scan signals, and, once every K data pulses, masks data pulses with mask signals that are shifted one pulse width of a scan signal for each data electrode group. According to another embodiment of the present invention, a plasma display device comprises a plurality of scan electrodes, K data electrode groups, a scan driver, a data pulse phase control circuit, and data drivers.

The data electrode groups are divisions of a plurality of data electrodes that are arranged to intersect with the scan electrodes and that effect screen display by discharge that is brought about at intersections with the scan electrodes upon application of desired data pulses.

The scan driver successively applies scan signals to a plurality of scan electrodes at a desired pulse width.

Once every K data pulses, the data pulse phase control circuit creates mask signals in which pulses appear that straddle the points of change of the scan signals and that are shifted one pulse width of a scan signal for each data electrode group.

A data driver is provided for each data electrode group, and each data driver applies a data pulse that is masked by a mask signal to the data electrodes.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 8:
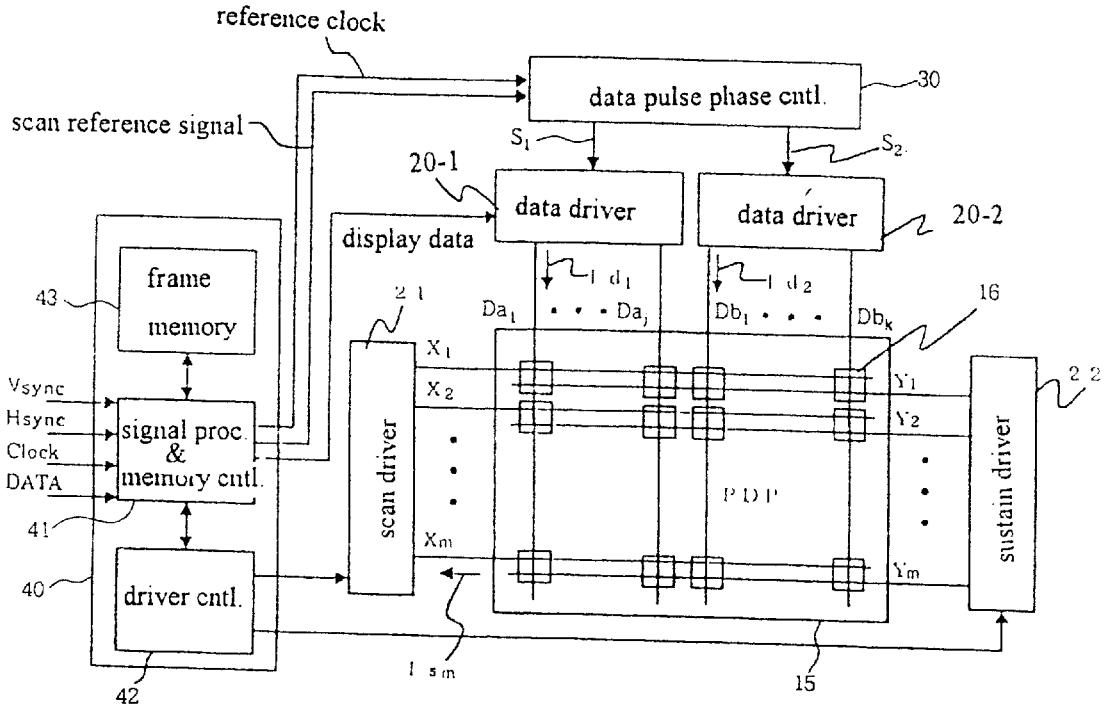
FIG. 8 is a block diagram showing the composition of the plasma display device according to one embodiment of the present invention.

Referring now to FIG. 8, there is shown a plasma display device according to an embodiment of the present invention comprising plasma display panel 15, control circuit 40, scan driver 21, sustain driver 22, data pulse phase control circuit 30, and data drivers 20-1 and 20-2.

Figure 5:
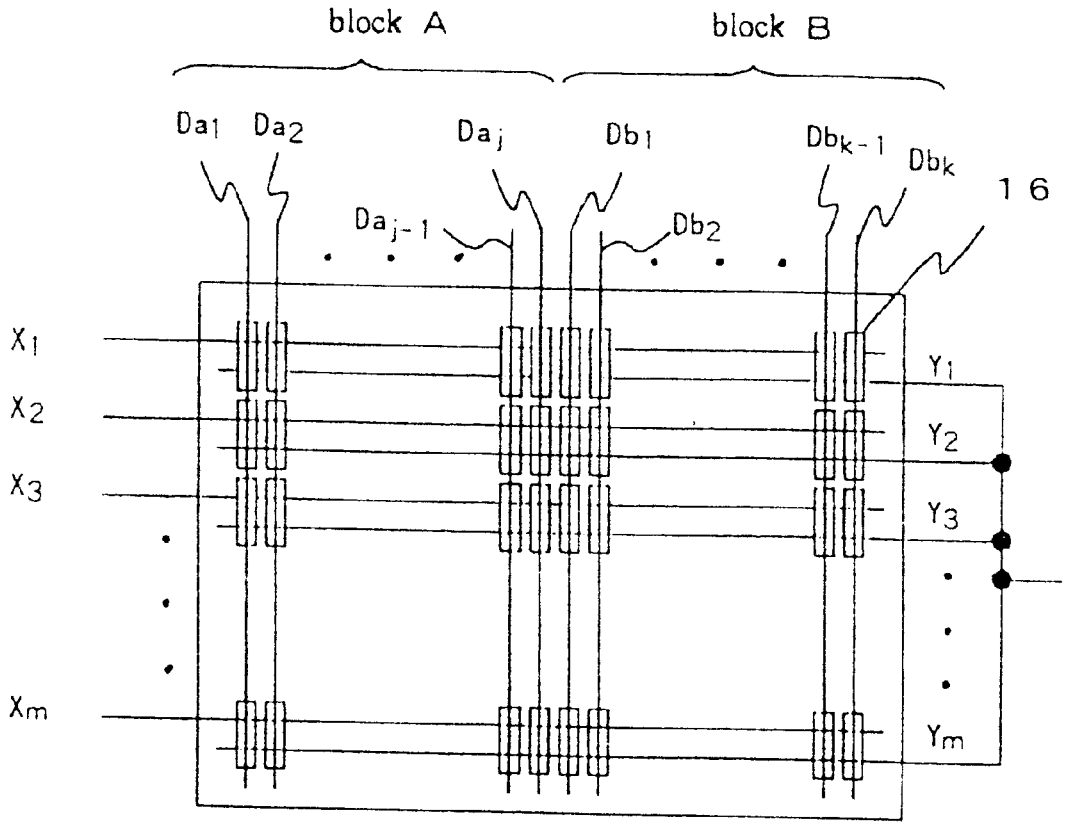
FIG.5 (Prior Art)
FIG. 5 is a block diagram showing the schematic composition of a PDP in which the data electrodes are divided into two data electrode groups.
Figure 6:
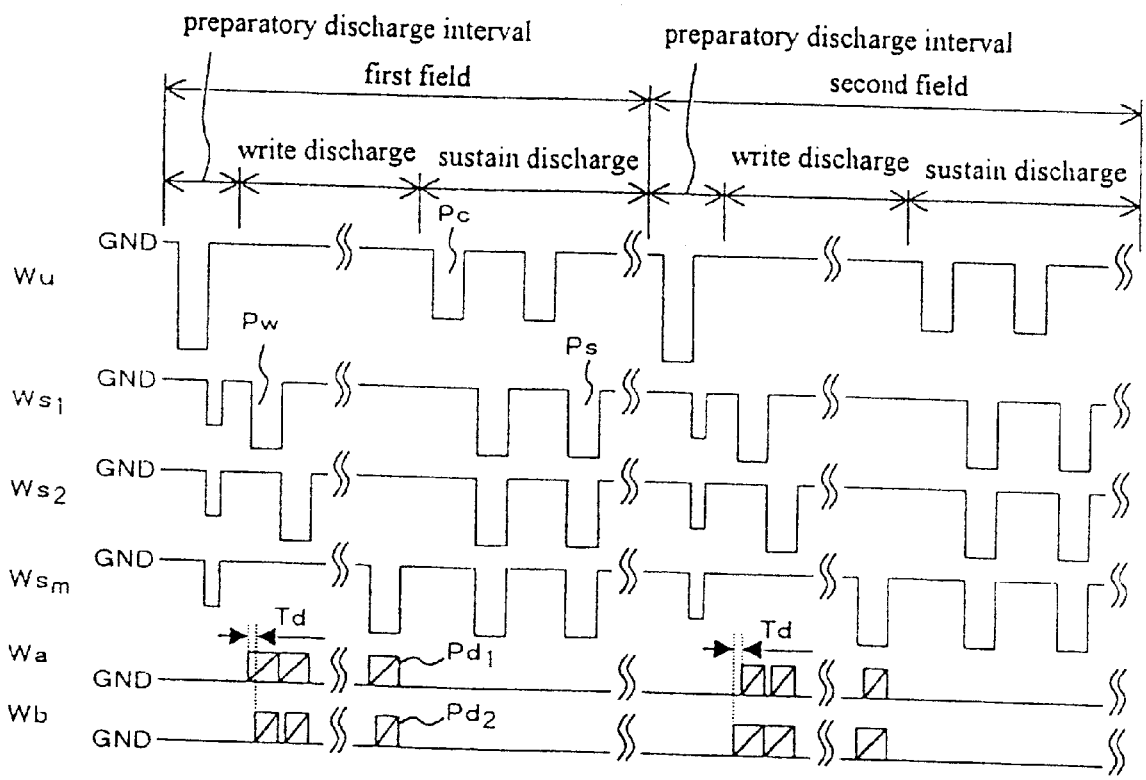
FIG.6 (Prior Art)
FIG. 6 is a timing chart showing the waveforms of signals that are applied to each electrode in the prior-art PDP described in the publication of Japanese Patent No. 2950270.
Figure 7:
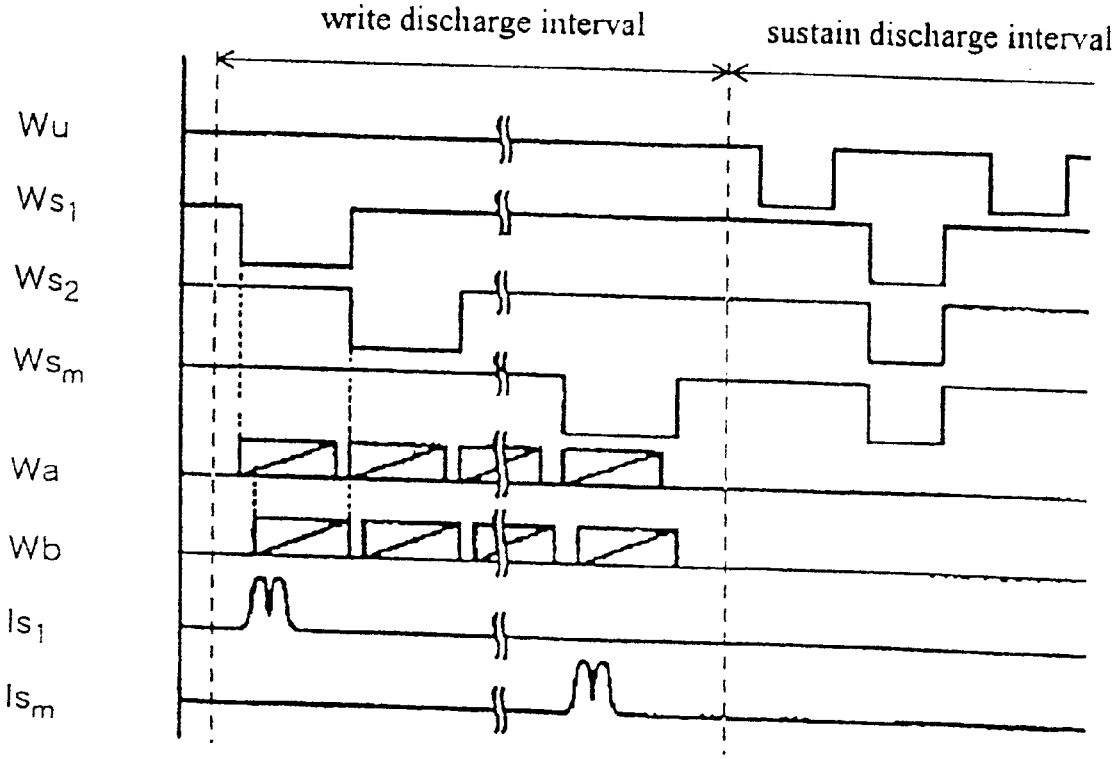
FIG.7 (Prior Art)
FIG. 7 is a timing chart showing the waveforms of signals that are applied to each electrode in the prior-art PDP that is described in the publication of Japanese Patent No. 2953342.

As in the plasma display panel of the prior art shown in FIG. 5, plasma display panel 15 comprises scan electrodes X1, X2, . . . , Xm, sustain electrodes Y1, Y2, . . . , Ym, and data electrodes Da1, Da2, . . . , Daj and Db1, Db2, . . . , Dbk.

Scan electrodes X1, X2, . . . , Xm are arranged in a horizontal direction and parallel to each other. Sustain electrodes Y1, Y2, . . . , Ym form pairs with respective scan electrodes X1, X2, . . . , Xm that are arranged in a horizontal direction and parallel to each other.

Data electrodes Da1, Da2, . . . , Daj and Db1, Db2, . . . , Dbk are arranged in a vertical direction and parallel to each other.

Data electrodes Da1, Da2, . . . , Daj and data electrodes Db1, Db2, . . . , Dbk each constitute a data electrode group. Data electrodes Da and Db intersect with a scan electrode X and a sustain electrode Y in each of the display cells that are arranged in matrix form.

Control circuit 40 includes signal processing memory control circuit 41, driver control circuit 42, and frame memory 43. Frame memory 43 is a memory for temporarily storing the data of a frame. Driver control circuit 42 controls the operation of scan driver 21 and sustain driver 22.

Signal processing memory control circuit 41 receives as input: clock signal "Clock," which is the reference clock of the display operation; vertical synchronizing signal Vsync, which is a signal indicating the starting point of a frame; horizontal synchronizing signal Hsync, which is a signal indicating the starting point of a horizontal scan line; and display data signal DATA that reports data that are to be displayed on the screen. Signal processing memory control circuit 41 then writes display data to or reads display data from frame memory 43. Signal processing memory control circuit 41 also controls driver control circuit 42 for scanning. In addition, signal processing memory control circuit 41 applies as input to data pulse phase control circuit 30 an internal clock signal and a scan reference signal for generating the output timing of data pulses.

Finally, signal processing memory control circuit 41 applies display data to data drivers 20-1 and 20-2.

Scan driver 21 applies scan electrode drive pulse signals to scan electrodes X1, X2, . . . , Xm. Sustain driver 22 applies sustain electrode drive pulse signals to sustain electrodes Y1, Y2, . . . , Ym. Data driver 20-1 applies data electrode drive pulse signals to data electrodes Da1, Da2, . . . , Daj; and data driver 20-2 applies data electrode drive pulse signals to data electrodes Db1, Db2, . . . , Dbk.

Figure 1:
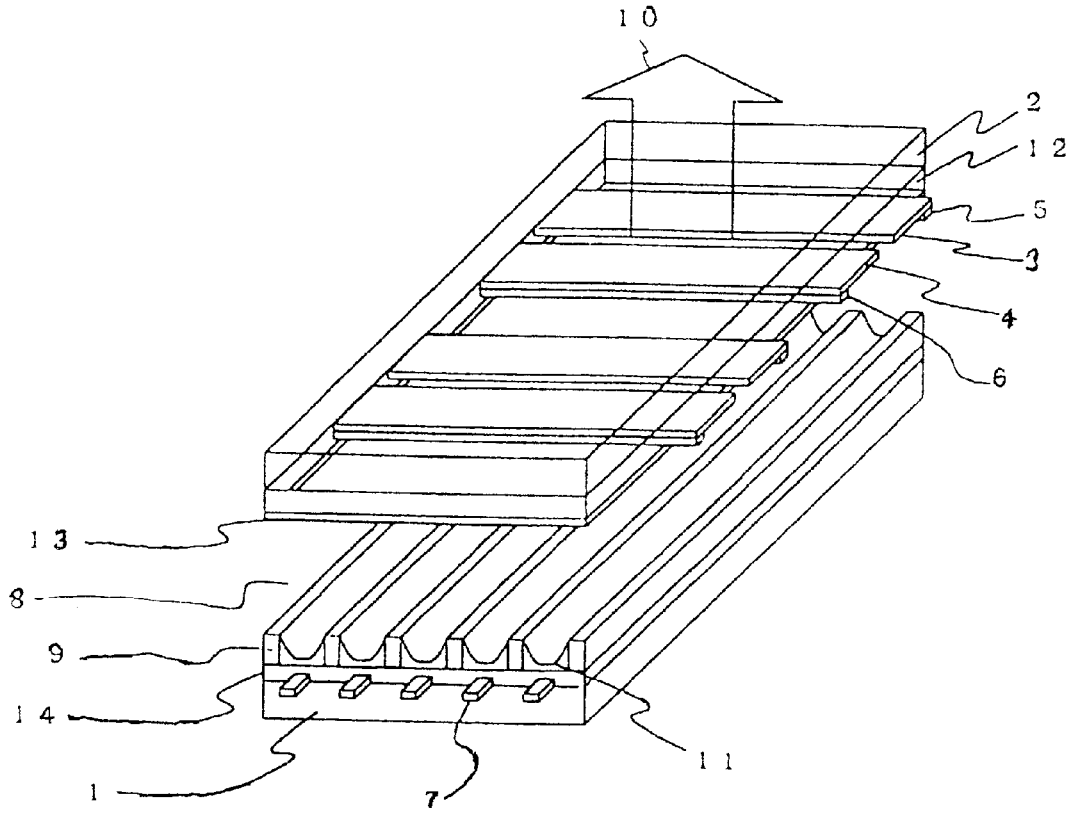
FIG.1 (Prior Art)
FIG. 1 is a perspective section showing an example of the composition of a display cell in an ac discharge memory-operated type of PDP.
Figure 2:
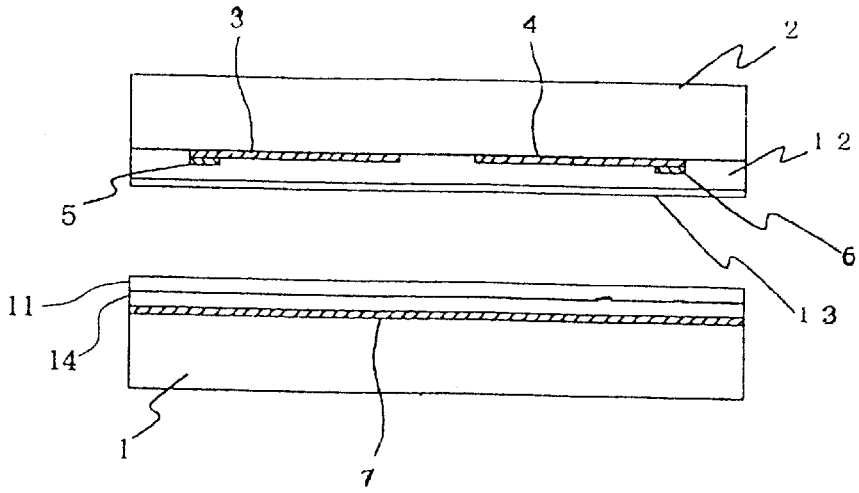
FIG.2 (Prior Art)
FIG. 2 is a vertical section of a single display cell in the ac discharge memory-operated type PDP shown in FIG. 1.
Figure 3:
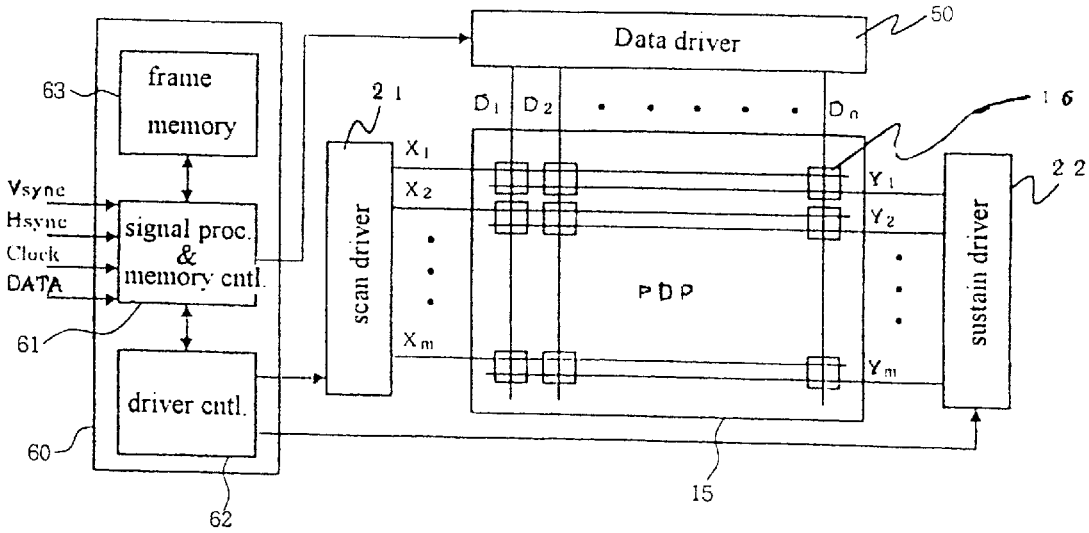
FIG.3 (Prior Art)
FIG. 3 is a block diagram showing the schematic composition of: the PDP formed from the display cells shown in FIG. 2 arranged in a matrix, a control circuit, a scan driver, a sustain driver, and a data driver.
Figure 4:
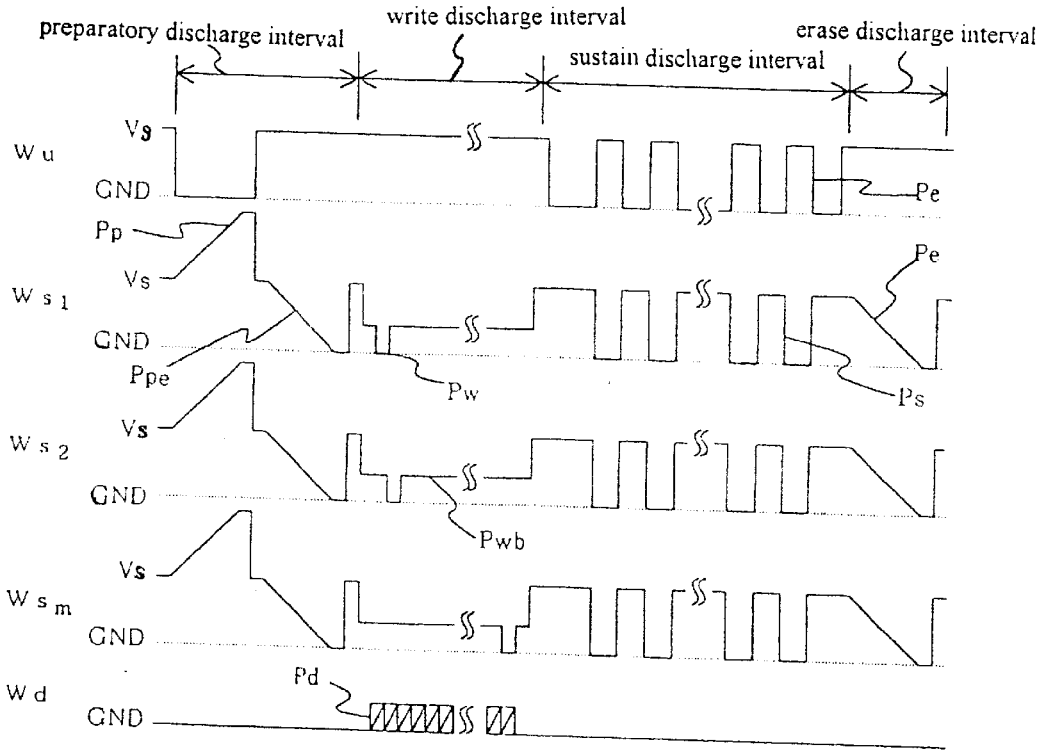
FIG.4 (Prior Art)
FIG. 4 is a timing chart showing the output waveforms of the scan driver, sustain driver, and data driver.
Figure 9:
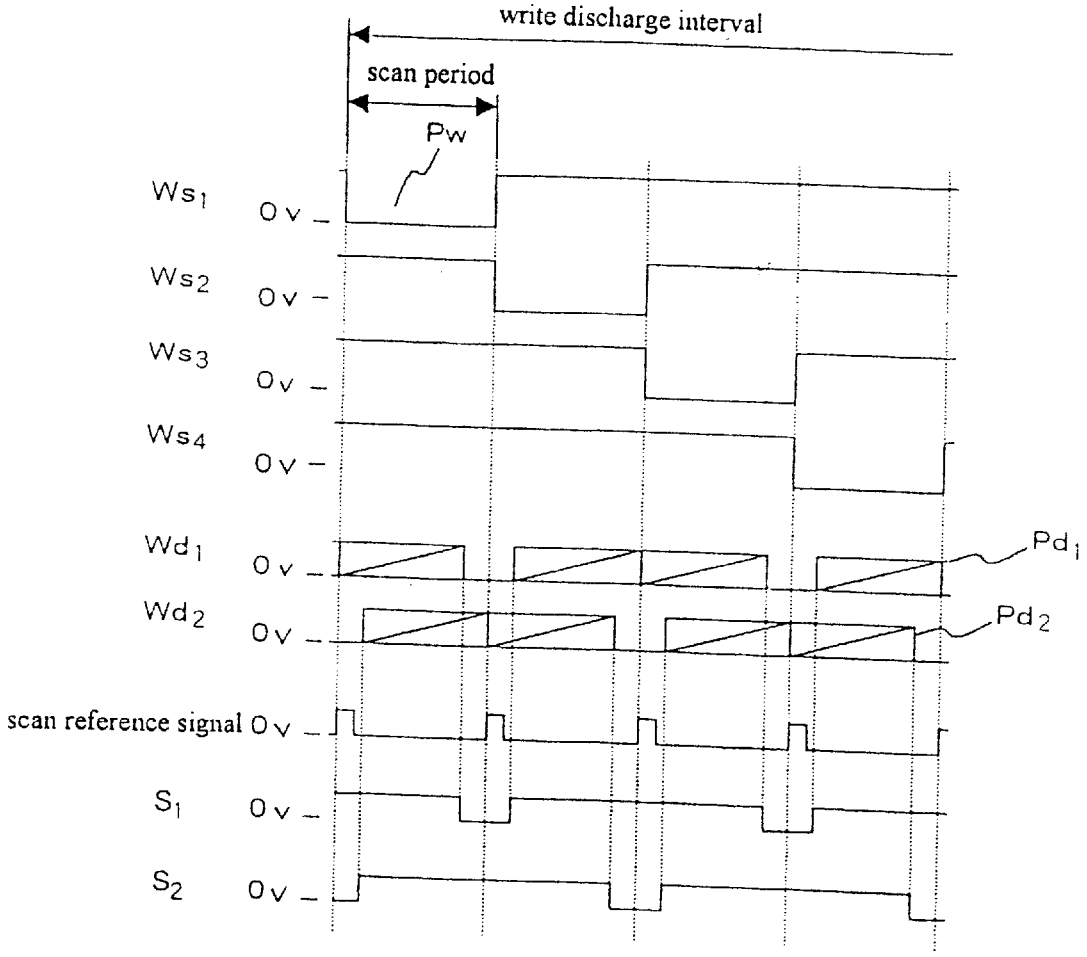
FIG. 9 is a timing chart for explaining the operation of the plasma display device.

FIG. 9 is a timing chart for explaining the operation of the plasma display device, and is an enlargement of the write discharge interval of the timing chart shown in FIG. 4.

Scan electrode drive pulse signals Ws1, Ws2, Ws3, and ws4 are signals that are to be applied to scan electrodes X1, X2, X3, and X4. Data electrode drive pulse signals Wd1 and Wd2 are signals that are to be applied to data electrodes Da1, Da2, . . . , Daj and data electrodes Db1, Db2, . . . , Dbk, respectively. Further, the diagonal lines that have been added to data electrode drive pulse signals Wd1 and Wd2 in the figure show whether data electrode drive pulse signals Wd1 and Wd2 take a H-level state or a L-level state in accordance with display data DATA.

As shown in FIG. 9, data pulse phase control circuit 30 generates timing signals S1 and S2 based on scan reference signals and internal clock signals and apply these signals to data drivers 20-1 and 20-2, respectively. Timing signals S1 and S2 are timing signals for the output of data by data drivers 20-1 and 20-2 to data electrodes Da1, Da2, . . . , Daj and data electrodes Db1, Db2, . . . , Dbk. Timing signals S1 and S2 are repetitions of pulse strings composed of a pulse in which the start timing is delayed and a pulse in which the end timing is advanced, the phase of these pulse strings being different for each data driver.

Data driver 20-1 outputs display data to data electrodes Da1, Da2, . . . , Daj at timings in which timing signal S1 is H level. Data driver 20-2 outputs display data to data electrodes Db1, Db2, . . . , Dbk at timings in which timing signal S2 is H level.

In a time interval in which timing signal S1 is L level, data driver 20-1 masks display data and does not output to data electrodes Da1, Da2, . . . , Daj. In a time interval in which timing signal S2 is L level, data driver 20-2 masks display data and does not output to data electrodes Db1, Db2, . . . , Dbk.

A time interval in which timing signals S1 and S2 are L level is an interval in which scan electrode drive pulse signals Ws1, Ws2, Ws3, and ws4 straddle points of change. Timing signals S1 and S2 change to L level Td1 earlier than a point of change and change to H level Td2 later than a point of change. In other words, the time interval in which timing signals S1 and S2 are L level is an interval of Td1+Td2.

According to the present embodiment, the end timing of a data pulse is shifted for each data electrode group, thereby reducing the noise level. According to the present embodiment, moreover, continuing the same number of data pulses as the number of data electrode groups (which is two in this example) both reduces the charge/discharge current caused by returning once to the reference potential at the end timing and reduces power consumption.

By improving the data electrode drive pulses of a write discharge interval, the plasma display device of the present embodiment lowers the peak value of each electrode current, reduces noise, and moreover, reduces power consumption as compared with an ac discharge memory-operated type plasma display device of the prior art.

Figure 10:
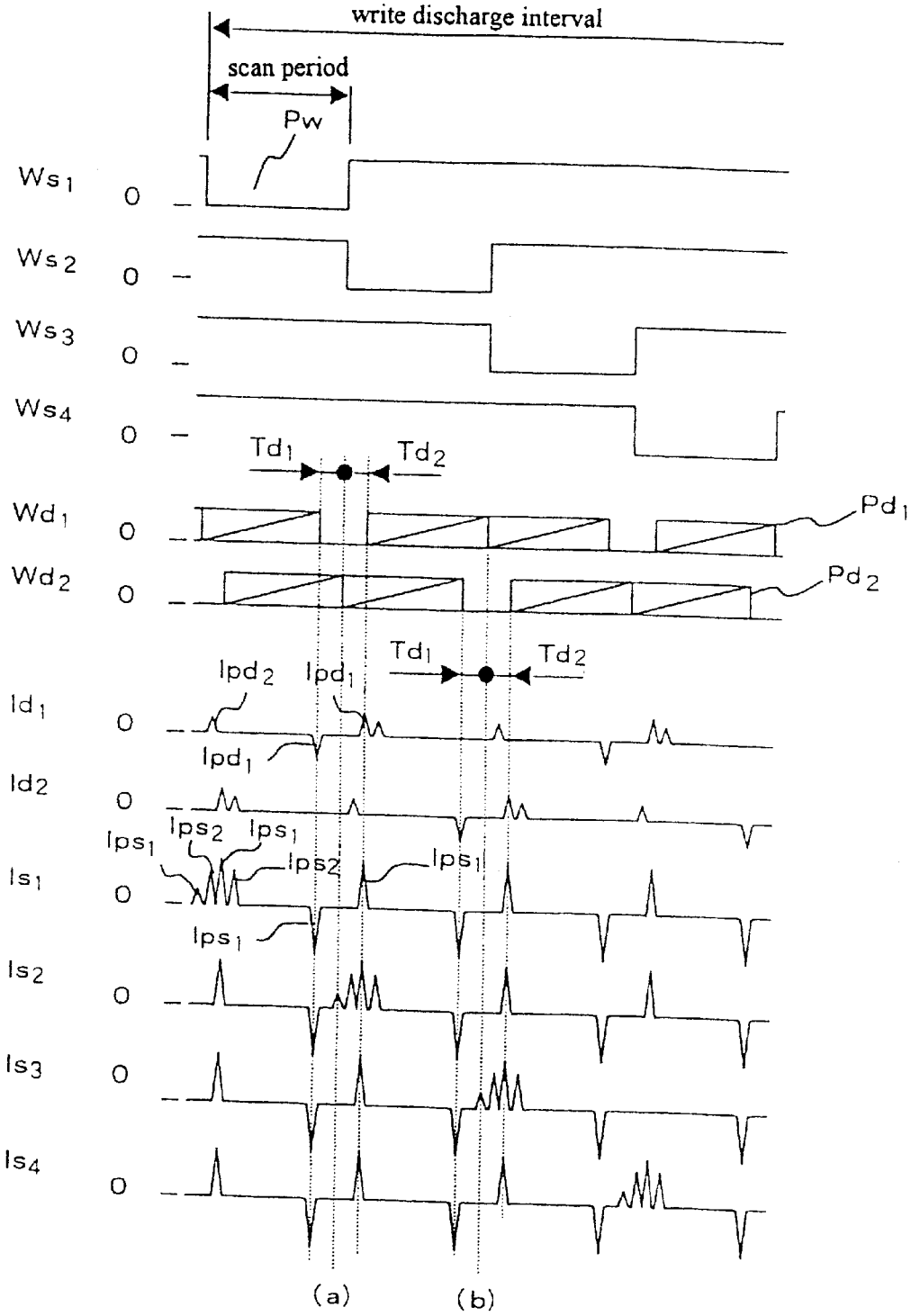
FIG. 10 is a timing chart showing the signals that are applied to the scan electrodes and data electrodes and each electrode current in an embodiment of the present invention.

As shown in FIG. 10, in the plasma display of this embodiment, scan electrode drive pulse signals Ws1, Ws2, Ws3, and Ws4 are applied to scan electrodes X1, X2, X3, and X4 in a write discharge interval. Scan electrode drive pulse signals Ws1, Ws2, Ws3, and Ws4 successively transmit pulse Pw of the scan period to scan electrodes X1, X2, X3, and X4. Data electrode drive pulse signal Wd1 is applied to data electrodes Da1, Da2, . . . , Daj. Data electrode drive pulse signal Wd2 is applied to data electrodes Db1, Db2, . . . , Dbk. Data electrode drive pulse signals Wd1 and Wd2 are signals in which pulse Pd1, in which the start timing is delayed by time Td2 from the scan period and the end timing coincides with the scan period, and data pulse Pd2, in which the start timing coincides with the scan period and the end timing is advanced from the scan period by time Td1, appear alternately. The data pulses of data electrode drive pulse signal Wd1 and data electrode drive pulse signal Wd2 are of opposite phase. Thus, the start timing and end timing of data pulses accordingly differ for each data electrode group. In addition, for every two data pulses, the end timing of a particular data pulse and the start timing of the next data pulse coincide. In this case, the effective data pulse width that contributes a write discharge is the time of the scan period less the time Td2 in data pulse Pd1, and the time of the scan period less time Td1 in data pulse Pd2. These times can ensure a sufficient discharge interval for writing data to display cells.

Since the start timing and end timing of a data pulse are shifted for each data electrode group, the timing at which charge/discharge current Ipd1 and light emission current Ipd2 flow as data electrode currents Id1 and Id2 differs for each data electrode group. Charge/discharge current Ipd1 is a current that charges and discharges the electrostatic capacity between electrodes with changes of the data pulse. Light emission current Ipd2 is a current that flows with writing. The timing at which charge/discharge current Ipsl and light emission current Ips2 flow as scan electrode currents Is1, Is2, Is3, and Is4 is therefore different for each data electrode group.

Charge/discharge current Ips1 is a current that charges and discharges electrostatic capacity between electrodes with changes of the drive pulse. Light emission current Ips2 is current that flows with writing. The peak value of each electrode current at the start timing and end timing of a data pulse is thus reduced, and noise is reduced.

Since for every two data pulses, the end timing of a particular data pulse coincides with the start timing of the next data pulse, the data electrode pulse signal does not return to the reference potential between these two data pulses in the case of display data in which these two data pulses continuously perform writing in display cells. Power consumption is therefore reduced because the charge/discharge current that charges and discharges the electrostatic capacity between electrodes does not flow.

The waveforms of data electrode currents ld1 and ld2 and scan electrode currents Is1, Is2, Is3, and Is4 that are shown in FIG. 10 are for a case in which all data pulses are generated in the interval shown in the figure. However, depending on the pattern of the display data, the data pulses do not continue and the charge/discharge current that charges and discharges the electrostatic capacity between electrodes flows at timing (a) or (b). Even in this case, the peak value of the charge/discharge current decreases because the end timing and start timing diverge for each data electrode group.

Figure 11:
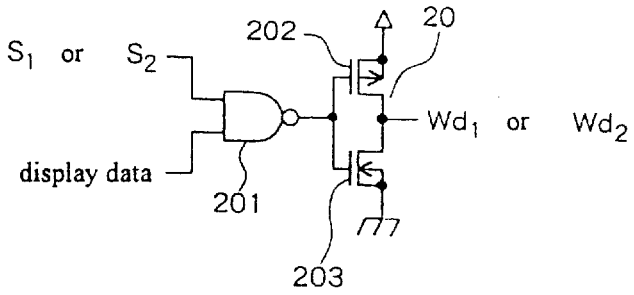
FIG. 11 is a circuit diagram showing an example of the configuration of a data driver.

FIG. 11 is a circuit diagram showing an example of the configuration of data driver 20. According to this example of the configuration, data driver 20 comprises NAND element 201, p-channel FET 202, and n-channel FET 203.

NAND element 201 takes as input display data and timing signal S1 or timing signal S2. P-channel FET 202 has its gate connected to the output of NAND element 201 and its source connected to the power-supply voltage. The gate of n-channel FET 203 is connected to the output of NAND element 201, and its drain is grounded. The drain of p-channel FET 202 is connected to the drain of n-channel FET 203, and generates data electrode drive pulse signal Wd1 or Wd2.

Figure 12:
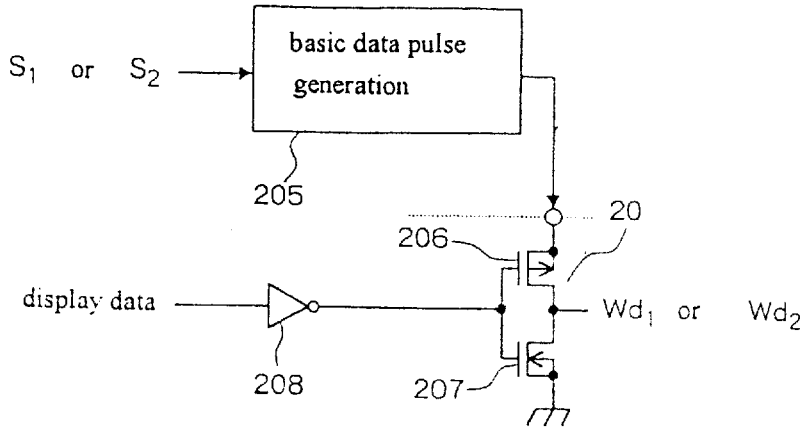
FIG. 12 is a circuit diagram showing another example of the configuration of a data driver.
Figure 13:
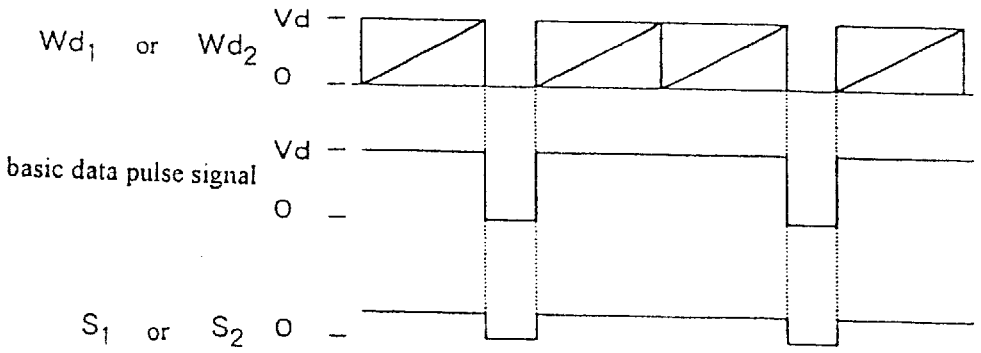
FIG. 13 is a timing chart showing the operation of the circuit of FIG. 12.

FIG. 12 is a circuit diagram showing another example of the configuration of data driver 20, and FIG. 13 is a timing chart showing the operation of the circuit of FIG. 12. According to the example of the configuration of FIG. 12, data driver 20 comprises: basic data pulse generation circuit 205, p-channel FET 206, and n-channel FET 207.

Basic data pulse generation circuit 205 creates from timing signal S1 or S2 a basic data pulse signal in which the timing of the rise and fall match the timing signal and the amplitude is amplitude Vd that should be applied to the data electrodes as a data pulse. Display data are applied as input via inverter 208 to the gates of p-channel FET 206 and n-channel FET 207. Basic data pulse signals are applied as input to the source of p-channel FET 206. The source of n-channel FET 207 is grounded. The drain of p-channel FET 206 is connected to the drain of n-channel FET 207, and generates data electrode drive pulse signal Wd1 or Wd2.

Here, data electrode drive pulse signals Wd1 and wd2 are H level (Vd in FIG. 13) for the data electrodes of display cells that are to emit light, while the data electrode drive pulse signals for the data electrodes of display cells that are not to emit light are L level (0 V in FIG. 13).

In the plasma display device of another embodiment of the present invention, the data electrodes are divided into three data electrode groups, and the plasma display device includes three data drivers for generating data electrode drive pulse signals to each of the data electrode groups.

Figure 14:
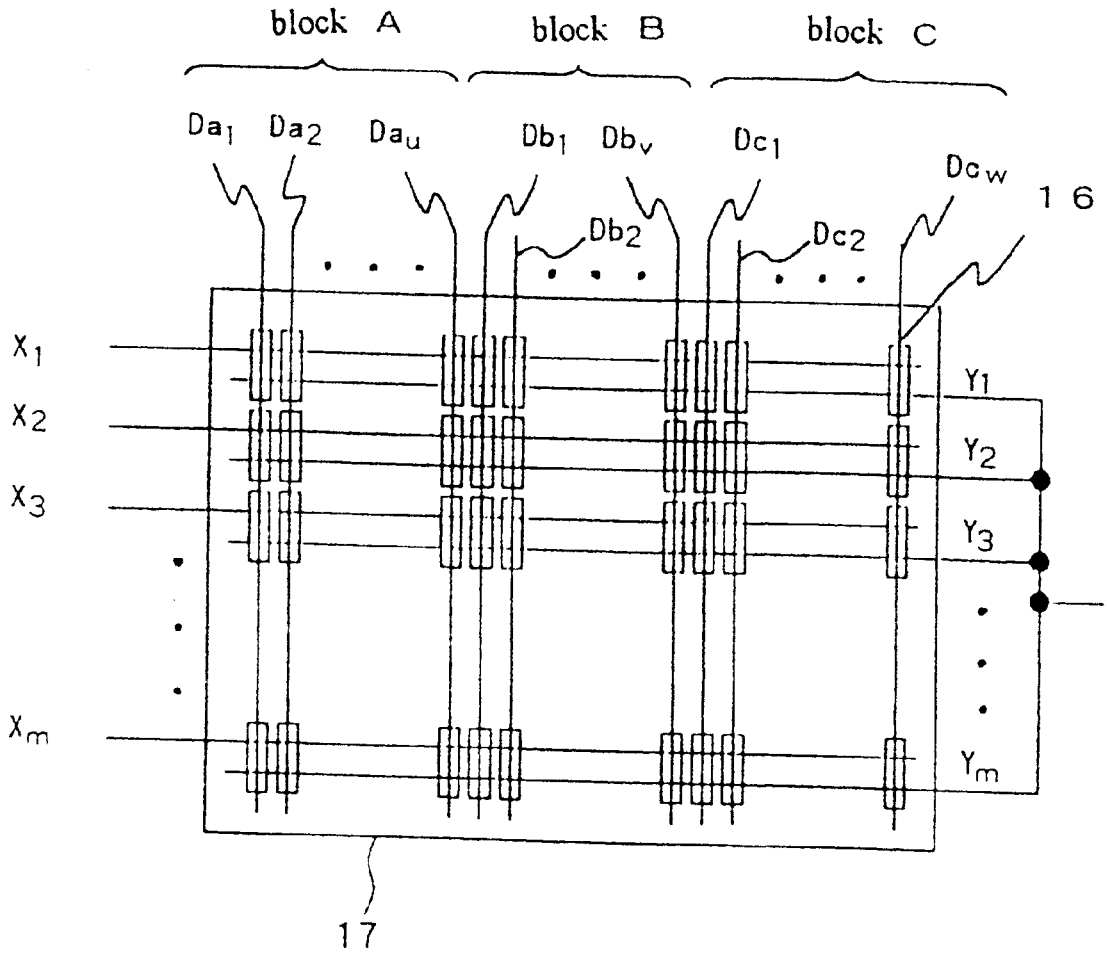
FIG. 14 is a block diagram showing the configuration of the plasma display panel according to another embodiment of the present invention.

Referring now to FIG. 14, plasma display panel 17 includes scan electrodes X1, X2, . . . , Xm and sustain electrodes Y1, Y2, . . . , Ym. Scan electrodes X1, X2, . . . , Xm are arranged in a horizontal direction and parallel to each other. Sustain electrodes Y1, Y2, . . . , Ym are arranged in a horizontal direction and parallel to each other, each forming a pair with a respective one of scan electrodes X1, X2, . . . , Xm. The data electrodes are divided into three data electrode groups composed of a data electrode group Da1, Da2, . . ., Dau, data electrode group Db1, Db2, . . . , Dbv, and data electrode group Dc1, Dc2, . . . , Dcw.

Figure 15:
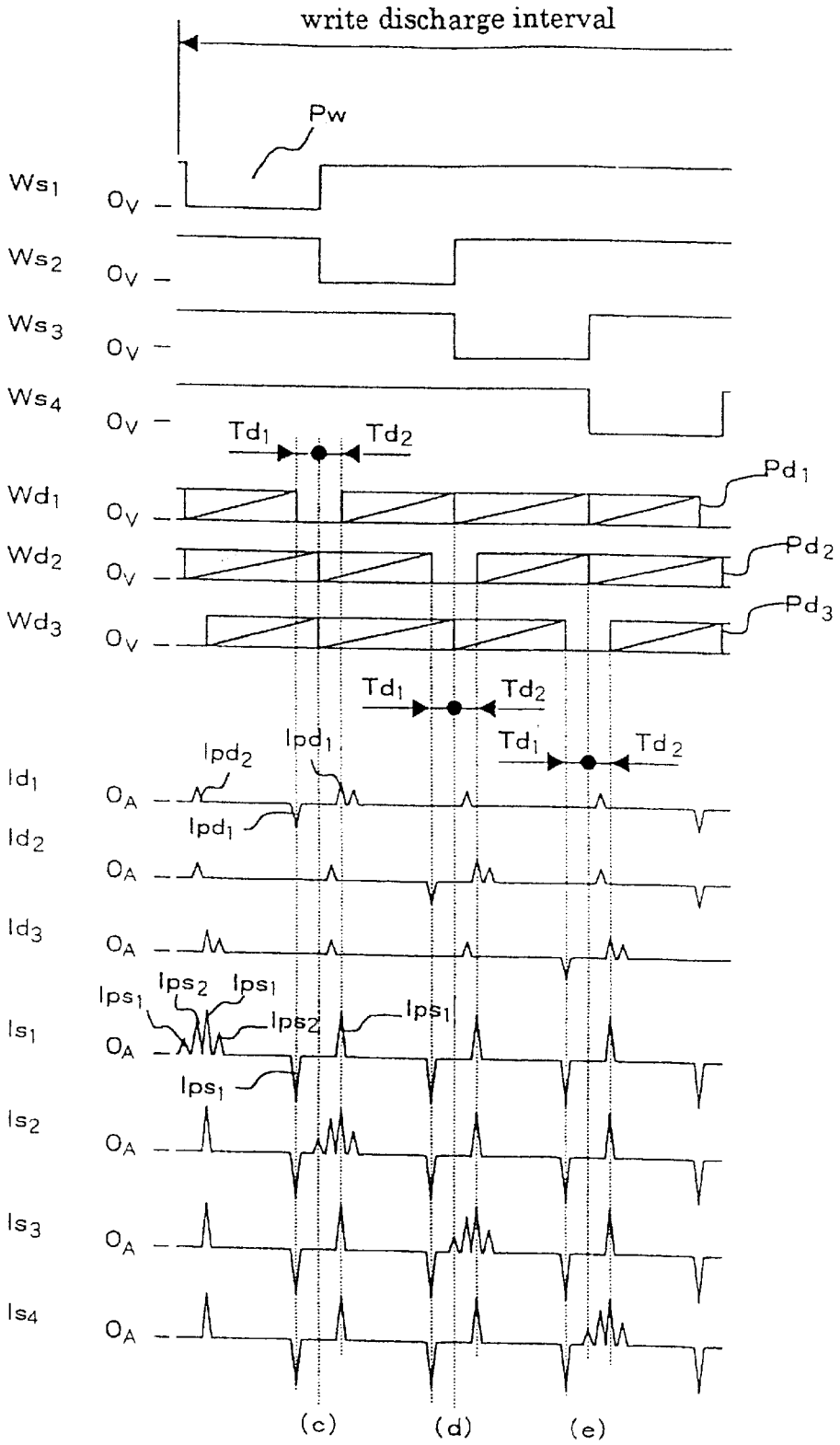
FIG. 15 is a timing chart showing the signals. that are applied to the scan electrodes and the data electrodes and each electrode current in another embodiment of the present invention.

The timing chart of FIG. 15 is an enlargement of four (Ws1–Ws4) of the M scan electrode drive pulse signals Ws1, Ws2, . . . , Wsm. As shown in FIG. 15, scan electrode drive pulse signals Ws1, Ws2, Ws3 and Ws4 are applied to scan electrodes X1, X2, X3, and X4 in a write discharge interval. Scan electrode drive pulse signals Ws1, Ws2, Ws3, and Ws4 successively transmit pulse Pw of the scan period to scan electrodes X1, X2, X3, and X4. Data electrode drive pulse signal Wd1 is applied to data electrodes Da1, Da2, . . . , Dau. Data electrode drive pulse signal Wd2 is applied to data electrodes Db1, Db2, . . . , Dbv. Data electrode drive pulse signal Wd3 is applied to data electrodes Dc1, Dc2, . . . , Dcw. Data electrode drive pulse signals Wd1, Wd2, and Wd3 are signals in which: a pulse in which the start timing is delayed by Td2 from the switch timing of the scan period and the end timing coincides with the switch timing of the scan period, a pulse in which the start timing and the end timing both coincide with the switch timing of the scan period, and a pulse in which the start timing coincides with the switch timing of the scan period and the end timing is advanced by Td1 from the switch timing of the scan period, appear successively. In addition, the phases of the data pulses of data electrode drive pulse signal Wd1, data electrode drive pulse signal Wd2, and data electrode drive pulse signal Wd3 are successively shifted by ⅓ period.

According to this embodiment, the start timing and end timing of the data pulses of at least one data electrode group diverge from that of the other data electrode groups, whereby the timing at which charge/discharge current Ipd1 and light emission currents Ipd2 and Ipd3 flow as data electrode currents ld1, ld2 and ld3 is different in at least one data electrode group. In other words, time Td2 is set such that, for example, the peak timing of light emission currents Ipd2 and Ipd3 diverges from the peak timing of data electrode current ld1. Charge/discharge current Ipd1 is a current that charges and discharges the electrostatic capacity between electrodes with changes in the drive pulse. Light emission currents Ipd2 and Ipd3 are currents that flow with writing.

The timing at which charge/discharge current Ips1 and light emission current Ips2 flow as scan electrode currents Is1, Is2, . . . , Ism is therefore different in at least one data electrode group from the others. Charge/discharge current Ips1 is a current that charges and discharges the electrostatic capacity between electrodes with changes in the drive pulse.

Light emission current Ips2 is a current that flows with writing. The peak values of each of the electrode currents are therefore reduced at the start timing and end timing of a data pulse, and noise is reduced.

In addition, the end timing of a data pulse coincides with the start timing of the next data pulse at two places for every three data pulses and thus, in the case of display data in which these three data pulses continuously write to display cells, the data electrode drive pulse signals do not return to reference potential (0 V in FIG. 15) at these two places. The current consumption is therefore reduced because charge/discharge current that charges and discharges the electrostatic capacity between electrodes does not flow.

The waveforms of data electrode currents Id1, Id2, and Id3 and scan electrode currents Is1, Is2, Is3, and Is4 that are shown in FIG. 15 are for a case in which all data pulses are generated in the interval shown in the figure. Depending on the pattern of the display data, however, the data pulses do not continue and a current flows which charges/discharges the electrostatic capacity between electrodes at the timing of (c), (d), or (e). Despite such a case, the start timing and end timing of at least one data electrode group are shifted from the others and the peak value of the charge/discharge current is therefore reduced.

The method of dividing the data electrodes in the present invention is not limited to the embodiments that were described by way of example. Other dividing methods include a method in which adjacent data electrodes are included in different data electrode groups, and a method of dividing into strips with a plurality of data electrodes as units.

While the preferred embodiments of the present invention have been described using specific terms, such description is for illustrative purposes only, and it is to be understood that changes and variations may be made without departing from the spirit or scope of the following claims.

What is claimed is:

1. A method of driving a plasma display panel in which a plurality of scan electrodes and a plurality of data electrodes are arranged to intersect with each other, and discharge is caused to occur at the points of intersection of said scan electrodes and said data electrodes upon application of a desired data pulse to said data electrodes, effecting screen display said method comprising steps of:

dividing said data electrodes into a plurality of data electrode groups; and applying a data pulse string, which is composed of a plurality of consecutive data pulses in which the start timing of the first data pulse is delayed by a predetermined time and the end timing of the last data pulse is advanced by a predetermined time, to said data electrodes at a different phase for each of said data electrode groups.

2. A method according to claim 1, wherein the time by which the start timing of said first data pulse is delayed is determined such that the timing at the peak of a light emission current diverges from the timing at the peak of a data electrode current.

3. A method according to claim 1, wherein the number of said data electrode groups is the same as the number of data pulses that make up said data pulse string.

4. A method according to claim 1, wherein the delay time of the start timing of said first data pulse is the same for all said data electrodes, and the advance time of the end timing of said last data pulse is the same for all said data electrodes.

5. A method according to claim 4, wherein said delay time is the same as advance time.

6. A method of driving a plasma display panel in which a plurality of scan electrodes and a plurality of data electrodes are arranged to intersect with each other, said data electrodes are divided into K data electrode groups for $2 \leqq K$, discharge occurs at the points of intersection of said scan electrodes and said data electrodes upon application of a desired data pulse to said data electrodes, and screen display is effected by means of this discharge, said method comprising steps of:

successively applying scan signals with a prescribed pulse width to said plurality of scan electrodes;

once every K data pulses, generating a mask signal having a pulse that includes the point of change of said scan signals while shifting one pulse width of said scan signal for each of said data electrode groups; and masking said data pulses with said mask signals.

7. A plasma display device comprising:

a plurality of scan electrodes;

a plurality of data electrode groups into which a plurality of data electrodes are divided, said data electrodes being arranged to intersect with said scan electrodes and effecting screen display by discharge that is brought about at intersections with said scan electrodes upon application of a desired data pulse;

a data pulse phase control circuit for generating, at a different phase for each data electrode group, pulse strings that are composed of a plurality of consecutive pulses in which the start timing of the first pulse is delayed by a predetermined time and the end timing of the last pulse is advanced by a predetermined time; and data drivers each associated with said data electrode group, for applying display data to said data electrodes in synchronism with said pulse strings.

8. A device according to claim 7, wherein the delay time of the start timing of said first pulse is predetermined such that the timing of the peak of a light emission current diverges from the timing of the peak of a data electrode current.

9. A device according to claim 7, wherein the number of said data electrode groups is the same as the number of pulses that constitute said pulse string.

10. A device according to claim 7, wherein the delay time of the start timing of said first pulse is the same for all of said data electrodes, and the advance time of the end timing of said last pulse is the same for all of said data electrodes.

11. A device according to claim 10, wherein said time of delay and said time of advance are the same.

12. A plasma display device comprising:

a plurality of scan electrodes;

K data electrode groups for $2 \leqq K$ into which a plurality of data electrodes are divided, said data electrodes being arranged to intersect with said scan electrodes and effecting screen display by discharge that is brought about at intersections with said scan electrodes upon application of a desired data pulse;

a scan driver for successively applying scan signals with a predetermined pulse width to said plurality of scan electrodes;

a data pulse phase control circuit for, once every K data pulses, generating a mask signal in which a pulse appear that straddle the point of change of said scan signals while shifting by one pulse width of said scan signals for each of said data electrode groups; and data drivers each associated with said data electrode group, for masking said data pulses with said mask signals to apply to said data electrodes.

* * * * *